US010549956B2

(12) United States Patent
Kuvaja et al.

(10) Patent No.: US 10,549,956 B2
(45) Date of Patent: Feb. 4, 2020

(54) METHOD FOR LIFTING AN INNER WEAR PART OF A GYRATORY OR CONE CRUSHER, AN INNER WEAR PART, A GYRATORY OR CONE CRUSHER AND AN INNER WEAR PART LIFTING TOOL

(71) Applicant: Metso Minerals, Inc., Helsinki (FI)

(72) Inventors: Kari Kuvaja, Tampere (FI); Aki Lautala, Tampere (FI)

(73) Assignee: METSO MINERALS, INC., Helsinki (FI)

( * ) Notice: Subject to any disclaimer, the term of this patent is extended or adjusted under 35 U.S.C. 154(b) by 1216 days.

(21) Appl. No.: 14/438,001

(22) PCT Filed: Oct. 9, 2013

(86) PCT No.: PCT/FI2013/050976
§ 371 (c)(1),
(2) Date: Apr. 23, 2015

(87) PCT Pub. No.: WO2014/064329
PCT Pub. Date: May 1, 2014

(65) Prior Publication Data

US 2015/0290648 A1 Oct. 15, 2015

(30) Foreign Application Priority Data

Oct. 26, 2012 (FI) ..... 20126109

(51) Int. Cl.
*B66C 1/42* (2006.01)
*B02C 2/00* (2006.01)
(Continued)

(52) U.S. Cl.
CPC ..... *B66C 1/422* (2013.01); *B02C 2/005* (2013.01); *B02C 2/04* (2013.01); *B02C 23/00* (2013.01); *B02C 2210/02* (2013.01)

(58) Field of Classification Search
CPC .. B02C 2/005; B02C 2/04; B02C 2/06; B02C 23/00; B02C 23/04; B66C 1/422; B66C 1/442; B66C 1/54; B25J 15/0047
(Continued)

(56) References Cited

U.S. PATENT DOCUMENTS 485,944 A * 11/1892 Jones
735,616 A * 8/1903 Stitt
(Continued)

FOREIGN PATENT DOCUMENTS

CN 2064268 10/1990
DE 20 2005 007 464 U1 7/2005
(Continued)

OTHER PUBLICATIONS

Chinese Office Action for Chinese Patent Application No. 2013800560914 dated May 27, 2016.
(Continued)

*Primary Examiner* — Dean J Kramer
(74) *Attorney, Agent, or Firm* — Andrus Intellectual Property Law, LLP

(57) ABSTRACT

A method for lifting an inner wear part of a gyratory or cone crusher and an inner wear part lifting tool for use with the method. The gyratory or cone crusher has a frame, an outer wear part fixable to the frame and the inner wear part fixable to a support cone of the crusher which outer and inner wear part define a crushing chamber. The inner wear part has an inner surface including a first inner support surface arranged, in a crushing phase, to be supported by a first counter surface of the support cone. In a first phase, a lifting arm of a lifting tool is arranged inside the inner wear part and under the inner surface of the inner wear part. In a second phase, an upper second counter surface of the lifting arm is coupled with a second inner support surface of the inner wear part.

2 Claims, 5 Drawing Sheets

(51) Int. Cl.
*B02C 23/00* (2006.01)
*B02C 2/04* (2006.01)

(58) Field of Classification Search
USPC ..... 294/82.13, 97
See application file for complete search history.

(56) References Cited

U.S. PATENT DOCUMENTS

| | | | | |
|---|---|---|---|---|
| 1,171,580 | A | 2/1916 | Atterbury | |
| 2,610,889 | A * | 9/1952 | Penn Penn | B66C 1/54 294/97 |
| 2,809,070 | A * | 10/1957 | Nelson | B66C 1/54 294/93 |
| 3,251,623 | A | 5/1966 | Fredholm | |
| 3,310,337 | A * | 3/1967 | Riemenschneider | B25J 15/00 294/110.1 |
| 3,355,114 | A | 11/1967 | Motz | |
| 3,750,967 | A | 8/1973 | DeDiemar et al. | |
| 4,474,400 | A | 10/1984 | Toffolon | |
| 5,323,976 | A | 6/1994 | Johnson et al. | |
| 5,769,340 | A | 6/1998 | Jean | |
| 6,609,742 | B1 | 8/2003 | Macom et al. | |

FOREIGN PATENT DOCUMENTS

| | | | | |
|---|---|---|---|---|
| DE | 10 2007 008 603 | A1 | 8/2008 | |
| FR | 2 459 077 | A3 | 1/1981 | |
| FR | 2701018 | A1 * | 8/1994 | B66C 1/54 |
| SU | 944639 | | 7/1982 | |
| SU | 1041145 | | 9/1983 | |
| WO | 2009/101237 | A1 | 8/2009 | |
| WO | 2011029133 | A1 | 3/2011 | |

OTHER PUBLICATIONS

Chinese Search Report for Chinese Patent Application No. 2013800560914 dated May 19, 2016.
PCT International Search Report and Written Opinion dated Apr. 9, 2014.
Finnish Office Action dated Aug. 16, 2013.
Office Action for Russian Patent Application No. 2015114935 dated Oct. 10, 2017.

* cited by examiner

METHOD FOR LIFTING AN INNER WEAR PART OF A GYRATORY OR CONE CRUSHER, AN INNER WEAR PART, A GYRATORY OR CONE CRUSHER AND AN INNER WEAR PART LIFTING TOOL

CROSS-REFERENCE TO RELATED APPLICATIONS

This application claims priority to PCT/FI2013/050976, filed Oct. 9, 2013, and published in English on May 1, 2014 as publication number WO 2014/064329, which claims priority to FI Application No 20126109, filed Oct. 26, 2012, incorporated herein by reference.

TECHNICAL FIELD

The invention relates to a method for lifting an inner wear part of a gyratory or cone crusher, an inner wear part and a gyratory or cone crusher. The invention relates particularly, though not exclusively, to mounting of the inner wear part of the gyratory or cone crusher onto a support cone of the crusher and dismounting from the support cone of the crusher. The invention relates also to a lifting tool for the inner wear part.

BACKGROUND ART

A crushing chamber is formed in gyratory and cone crushers between a fixed outer wear part and a movable inner wear part. Mineral material is crushed in the crushing chamber by moving the inner wear part radially through an excentric.

FIG. 1 shows a support cone 10 of a cone crusher, and an inner wear part 1 mounted onto the support cone is fixed by a fixing bolt 12. The fixing bolt 12 is covered by a cover 13. FIG. 2 shows a support cone 20 of a gyratory crusher and an inner wear part 1' mounted onto the support cone. The inner wear part 1' of the gyratory crusher is fixed onto the support cone 20 by a fixing nut 22 which is mounted on a shaft 23.

In FIGS. 1 and 2 the inner wear parts 1, 1' are fixed on the support cones 10, 20 through a torch ring 14. The torch ring 14 is welded at top to the fixing bolt 12 and correspondingly to the fixing nut 22 and from bottom to the inner wear part 1, 1'. The wear part is then further tightened on the support cone at the beginning of the crushing. When the wear part is detached the torch ring 14 is usually oxygen cut so that the fixing bolt/nut can be unscrewed. In some cases free space is formed for the oxygen cutting in the support cone immediately behind the torch ring.

Nowadays the inner wear part i.e. a mantle is typically lifted in place on the support cone by making use of projections 24 formed on an outer surface of the wear part such as "hooks" casted in connection with the manufacturing. Usually these projections are worn off in a worn wear part wherein new lifting points must be welded to the outer surface of the wear part when the wear part is dismounted.

The welding of the new lifting points to the wear part causes extra work phases and safety risks because it is difficult to control the quality of the welding operator and the weld. Replacing of the spent wear part by the new one takes place usually on site for example at a quarry. The wear part is usually difficult weldable material such as manganese steel, and a suitable welding additive is not necessarily available. Reliable joining of a lifting bracket of steel to a dirty manganese steel is difficult in construction conditions.

Lifting tools which are fixable to outside lifting points intended to lifting of the wear part are generally not fully lockable to the wear part, wherein realization of work safety and work safety regulations cannot be guaranteed in all circumstances. Detaching of the lifting tool from the wear part can damage the crusher. Dropping of the wear part can cause serious personal injuries.

WO 2011/029133 shows a lifting device for an inner wear part. Projections extending from a body of the lifting device are coupled with ribs formed to an edge of an opening of a wear part. The lifting device is rotated in the opening wherein the projections locate under the ribs. The lifting device is locked by preventing a backwards rotation of the lifting device. A radial recess formed additionally to the edge of the opening of the wear part is problematic because mineral material and water can enter in between the wear part and a support cone. When a torch ring is oxygen cut, vaporizing water and splashes cause a work safety risk. The edge of the opening of the wear part can be damaged during the oxygen cutting wherein the lifting device does not necessarily couple safely to the wear part.

An object of the invention is to create a reliable and simple method to handle the inner wear part. An object of the invention is to create a reliably liftable inner wear part. An object of the invention is to enhance safety of a crusher particularly in connection with the handling of the inner wear part. A particular object of the invention is to reduce dangerous operations in connection with the lifting of the inner wear part. A particular object is to create an alternative lifting tool which is lockable to the inner wear part.

SUMMARY

According to a first example aspect of the invention there is provided a method for lifting an inner wear part of a gyratory or cone crusher which gyratory or cone crusher comprises a frame, an outer wear part fixable to the frame and the inner wear part fixable to a support cone of the crusher which outer and inner wear part define together a crushing chamber for receiving crushable material, and the inner wear part comprises an inner surface to which is formed a first inner support surface which is arranged, in a crushing phase, to be supported by a first counter surface of the support cone, and the method comprising

- arranging in a first phase a lifting arm of a lifting tool inside the inner wear part and under the inner surface of the inner wear part, and
- coupling in a second phase an upper second counter surface of the lifting arm of the lifting tool with a second inner support surface of the inner wear part which second inner support surface is formed to an upper section of the inner surface of the wear part.

Preferably arranging, in the first phase in such a situation where the inner wear part is mounted on the support cone, the lifting arm of the lifting tool into a lifting tool space between the inner wear part and the support cone which lifting tool space is formed by arranging a relief to the inner surface of the inner wear part and/or to an outer surface of the support cone.

According to a second example aspect of the invention there is provided an inner wear part which is intended to be fixed to a gyratory or cone crusher which gyratory or cone crusher comprises a frame, an outer wear part fixable to the frame and the inner wear part fixable to a support cone of the crusher which outer and inner wear part define together a crushing chamber for receiving crushable material, and the inner wear part comprises an inner surface to which is formed a first inner support surface which is arranged, in a crushing phase, to be supported by a first counter surface of the support cone, and a second inner support surface is formed inside the inner wear part, to an upper section of the inner surface, which second inner support surface is arranged, in a lifting phase of the inner wear part, to couple with a second counter surface formed in a lifting tool.

According to a third example aspect of the invention there is provided a combination of an inner wear part and a lifting tool which inner wear part is intended to be fixed to a gyratory or cone crusher which comprises a frame, an outer wear part fixable to the frame and the inner wear part fixable to a support cone of the crusher which outer and inner wear part define together a crushing chamber for receiving crushable material, and the inner wear part comprises an inner surface to which is formed a first inner support surface which is arranged, in a crushing phase, to be supported by a first counter surface of the support cone, and a second inner support surface is formed inside the inner wear part, to an upper section of the inner surface, which second inner support surface is arranged, in a lifting phase of the inner wear part, to couple with a second counter surface formed in the lifting tool.

According to a fourth example aspect of the invention there is provided a gyratory or cone crusher comprising a frame, an outer wear part fixable to the frame and an inner wear part fixable to a support cone of the crusher which outer and inner wear part define together a crushing chamber for receiving crushable material, and the inner wear part comprises an inner surface to which is formed a first inner support surface which is arranged, in a crushing phase, to be supported by a first counter surface of the support cone, and the gyratory or cone crusher comprises a lifting tool space between the inner wear part and the support cone for receiving in a first lifting phase a lifting arm of a lifting tool which lifting tool space is formed by arranging a relief to the inner surface of the inner wear part and/or to an outer surface of the support cone, and a second inner support surface is formed inside the inner wear part, to an upper section of the inner surface, which second inner support surface is arranged, in a lifting phase of the inner wear part, to couple with a second counter surface formed in the lifting tool.

According to a fifth example aspect of the invention there is provided a lifting tool for an inner wear part which inner wear part is intended to be fixed to a gyratory or cone crusher, and the lifting tool comprises at least a first lifting arm and a second lifting arm and a pivot which enables pivoting of said lifting arms in relation to each other, and said lifting arms comprise an upper second counter surface which is arranged, in a lifting phase of the inner wear part, to couple with a second inner support surface which is formed to an upper section of the inner surface of the inner wear part.

Preferably the second inner support surface is a circular region on the inner surface of the inner wear part.

Preferably the second inner support surface comprises at least two inner support regions on the inner surface of the inner wear part. Preferably two second inner support surface regions are lie on opposite sides on the inner wear part.

The second inner support surface can be a recess on the inner surface of the inner wear part. The second inner support surface can be a segment on the inner surface of the inner wear part.

Preferably the second inner support surface comprises a threshold, an edging or a corresponding radially inwards directed material extension in the upper portion of the inner surface of the inner wear part. Preferably a cross sectional profile of the second inner support surface is at the upper portion inwards hook-like. Preferably the lifting arms are formed hook-like.

Preferably the second inner support surface is formed in connection with casting of the inner wear part. Preferably the second inner support surface is formed at least partly by machining the inner surface of the inner wear part.

Preferably the gyratory or cone crusher is arranged to a processing plant which is a stationary plant, an independently movable plant or a plant which is transportable on road.

The lifting tool can be supported on a support surface which is arranged to such a region of the inner surface of the inner wear part which is not intended to be supported by the support cone.

The lifting tool can be supported on a support surface which is arranged to such a region of the inner surface of the inner wear part which lies above the first counter surface of the support cone.

The design of the upper end of the inner wear part i.e. the mantle enables a simple and reliable operation of the lifting tool. Particularly in cone crushers there is usually very little space between the mantle and the upper portion of the support cone. Space for the lifting tool can be designed alternatively or additionally also to the upper portion of the support cone. The form intended for the lifting tool can be manufactured directly to the cast wherein the cost effect is very small. The lifting tool can be created fully in accordance with EU provisions so that the lifting tool is fully lockable to the piece which is lifted.

Preferably the second support surface extends at a distance from a support surface of the torch ring, i.e. an inner perimeter of the wear part which is in contact with the torch ring.

Outer wear of the mantle and operations during the dismounting of the mantle do not reduce operation reliability of the locking of the lifting tool. So for example the oxygen cutting necessary in connection with the dismounting of the mantle does not reduce the operation reliability of the second inner support surface inside the mantle in connection with the use of the lifting tool. Separate forms for the locking are not necessary to be formed in the edge of the opening in the upper portion of the mantle which forms could be damaged in connection with the oxygen cutting during the dismounting or through which forms impurities could enter in between the mantle and the support cone.

To secure the fixing of the lifting tool to the mantle no operations causing safety risks such as welding are needed. The lifting tool can be supported to a region which is not exposed to wearing by crushable material.

The safety in handling of the mantle can also be enhanced by a safety device to be formed to the lifting tool. I.a. a load which is substantially higher than the load caused by the mass of the mantle can be indicated by the safety device. Such a situation may arise for example if the mantle sticks to the underneath support cone and the lift is directed, additionally to the mantle, also to the rest of the crusher via the support cone.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
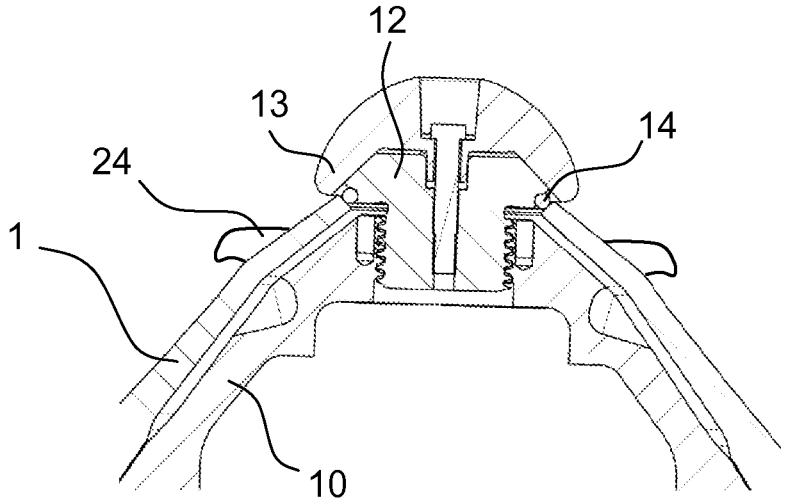
PRIOR ART FIG. 1
FIG. 1 shows a known inner wear part mounted on a support cone of a cone crusher.
Figure 2:
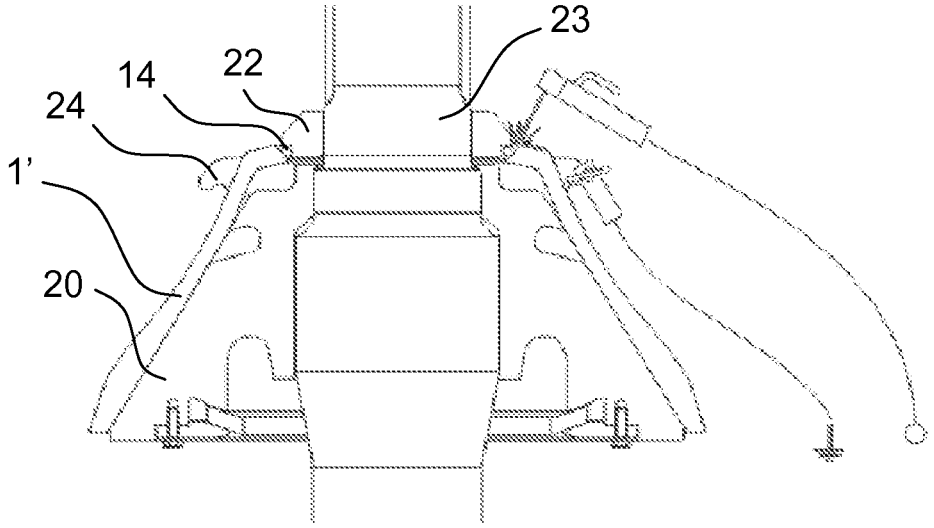
PRIOR ART FIG. 2
FIG. 2 shows a known inner wear part mounted on a support cone of a gyratory crusher.
Figure 3:
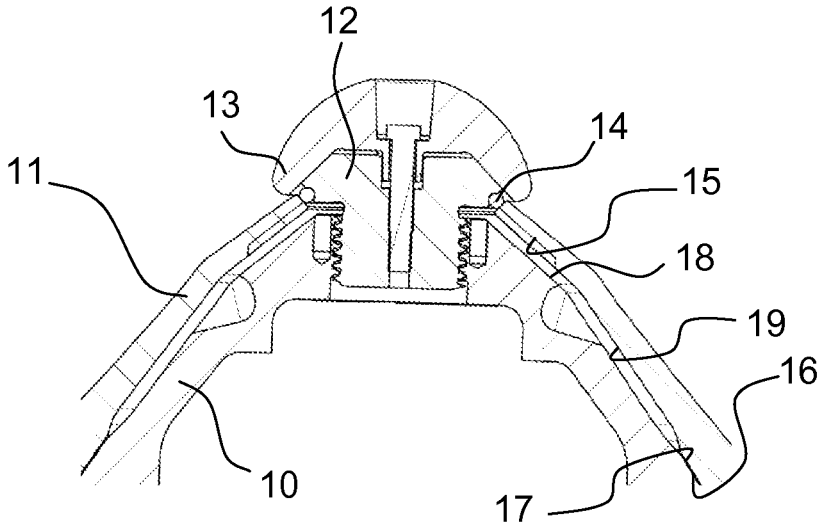
FIG. 3 shows an inner wear part according to a first preferable embodiment of the invention.
Figure 4:
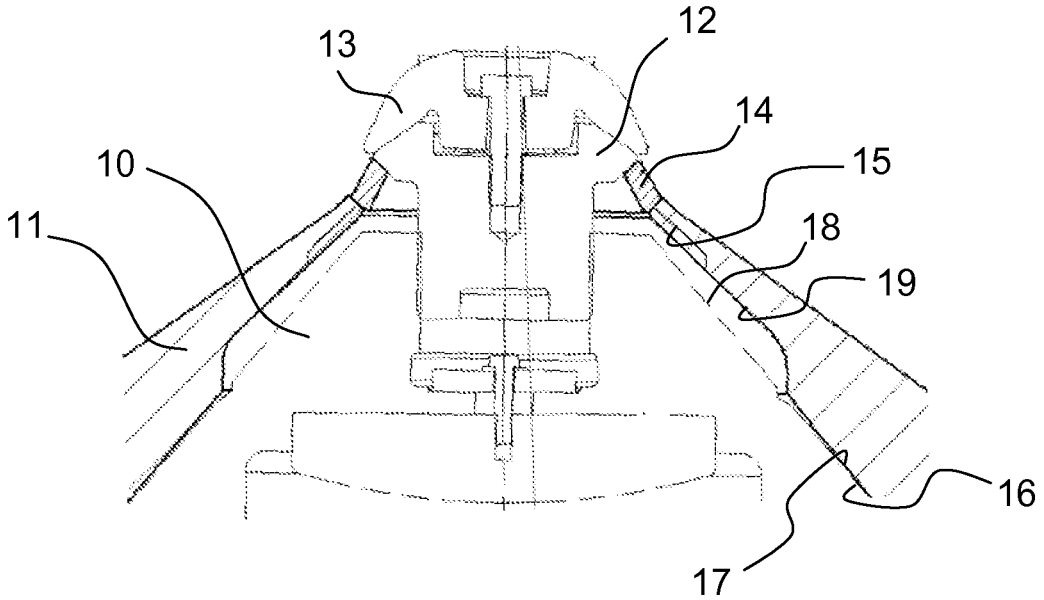
FIG. 4 shows an inner wear part according to a second preferable embodiment of the invention.

FIGS. 3 and 4 show alternative support cones 10 onto which are mounted inner wear parts 11 according to preferable embodiments of the invention. In FIG. 3 a cross section of a torch ring 14 is circular and in FIG. 4 square. No outer lifting points are needed in the wear parts 11 for lifting.

The inner wear part 11 comprises an inner surface to which is formed a first inner support surface 16 which is arranged to be supported by a first counter surface 17 formed to an outer surface 18 of the support cone 10 when the inner wear part is fixed on the support cone.

A second inner support surface 15 is formed to an upper section of the inner surface of the wear part 11. The support surface 15 is arranged, in a lifting phase of the inner wear part, to couple with a second counter surface (for example the second counter surface 38 of a lifting tool 30 in FIG. 5).

The second inner support surface 15 can be a unitary region on the lower inner surface of the inner wear part, for example a circular region. The second inner support surface 15 can be a relief, for example a recess, cavity, segment made to the inner surface. The second inner support surface 15 can consist of at least two reliefs. The second inner support surface 15 can also consist of several separate reliefs, for example of recesses in the inner surface.

In FIGS. 3 and 4 a short distance is formed at a region above the first support surface 16 in between the inner surface of the wear part 11 and the support cone where the inner surface is denoted with referral number 19. A second relief is additionally formed in the upper section of this inner surface region 19 at the location of the second inner support surface 15.

By the term relief is meant in this description reducing of the material of the wear part and/or the support cone in connection with the space in between the support cone and the wear part. A lifting tool space for receiving a lifting arm of the lifting tool is created by the relief in between the inner surface of the inner wear part and the support cone. The relief does not necessary mean reducing of a wall thickness of the wear part at the region of the second inner support surface. The wall of the wear part can also be directed outwards (also approximately uniform in thickness) that a sufficient wall thickness is formed to the wear part and that a sufficient lifting tool space is formed in between the support cone and the wear part for the lifting arm of the lifting tool.

Figure 5:
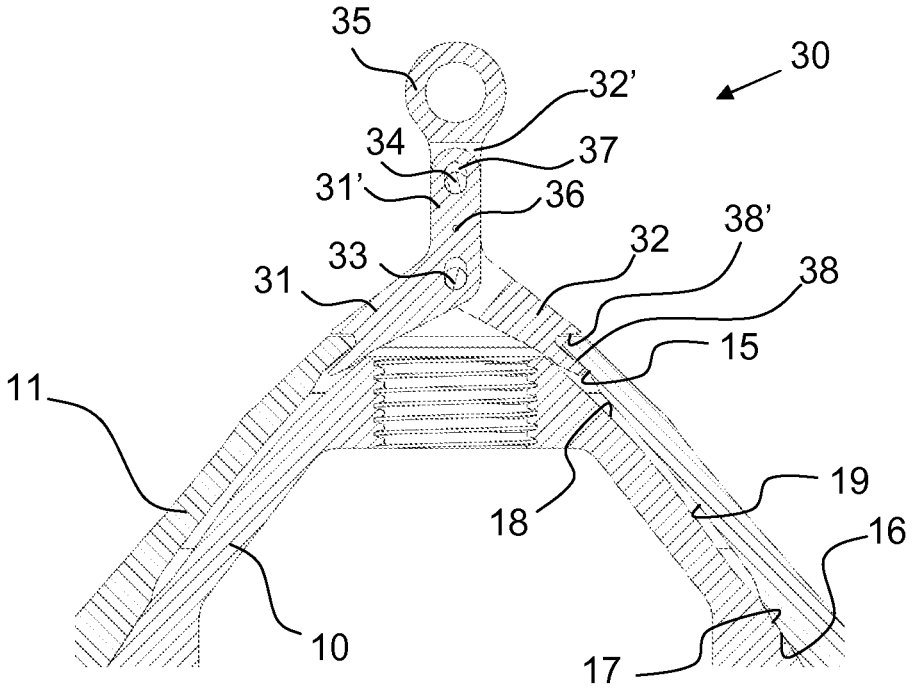
FIGS. 5-8 show inner wear parts according to some preferable embodiments of the invention to which some preferable lifting tools are locked.

In connection with FIG. 5 there is described an example of a lifting tool 30 which is suitable to be coupled with profiles of the wear parts shown in FIGS. 3 and 4. Examples of other lifting tools applicable with profiles of some other wear parts are shown in connection with FIGS. 6, 7 and 8.

Figure 6:
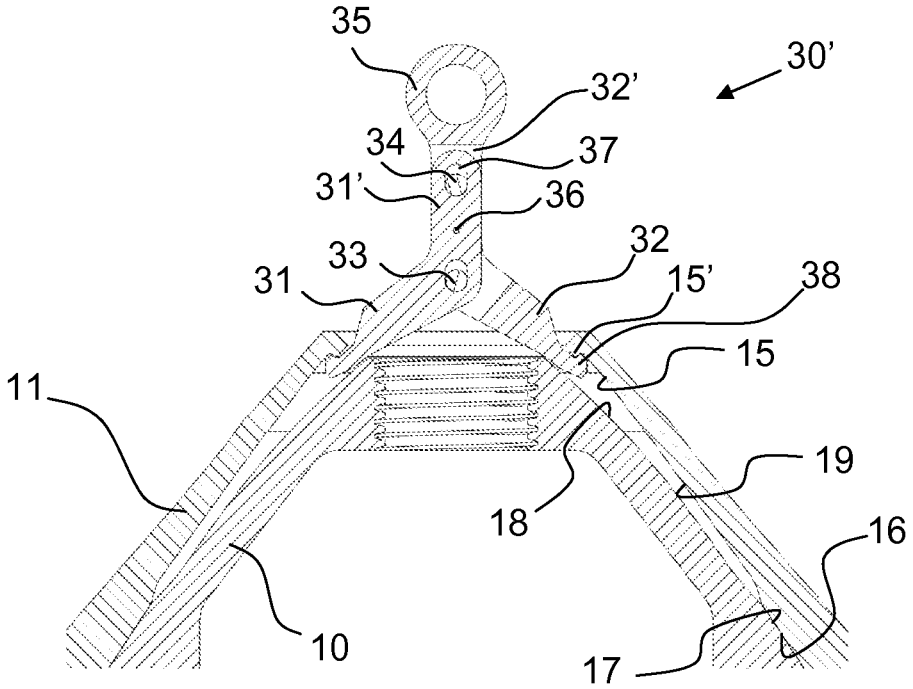

FIGS. 5 and 6 show inner wear parts 11 of a cone crusher and lifting tools 30, 30' coupled therewith. The lifting tool 30, 30' comprises a first lifting arm 31 and a second lifting arm 32 which are pivoted to each other with a pivot 33. The pivot 33 enables pivoting of the lifting arms in relation to each other and adapting into the lifting tool space between the support cone 10 and the wear part 11 when the locking bolt 12 is removed from the support cone 10. If necessary the lifting tool space is emptied from foreign objects. The lifting arms 31, 32 can be locked in a lifting position by placing a pin 34 suitable as a locking member through upper ends 31', 32' of the lifting arms 31, 32 at a point which is located above the pivot 33. The lifting tool comprises a lifting point 35 such as a lifting eye in a top of the one or the other lifting arm to be gripped by a lifting device.

The lifting tool is optionally equipped with a safety device 36 which indicates overload. The safety device comprises a "fuse" such as a shear pin wherein the operator clearly notices the overload at the break thereof. In connection with the safety device there are formed longitudinal holes 37 for cooperation with the pivot and the pin 34 enabling moving of the pivot and the pin in the holes 37, i.e. a short increase of the distance between the lifting eye and the lifting arms, for example a few millimeters. Naturally the lifting tool can be implemented without the safety device.

When the inner wear part is gripped with the lifting tool, regions of at least two lifting arms 31, 32 of the lifting tool 30, 30' having second counter surfaces 38 are arranged inside the inner wear part and under the inner surface of the wear part, and the upper second counter surface 38 of the lifting arm 31, 32 of the lifting tool 30 is coupled with the second inner support surface 15 of the inner wear part 11 which second inner support surface is formed to the upper section of the inner surface of the wear part.

In case the inner wear part 11 is readily on the support cone 10 and one wants to lift the wear part off the support cone, the lifting arm of the lifting tool is arranged into the lifting tool space between the inner wear part and the support cone which lifting tool space is formed by arranging the relief to the inner surface of the inner wear part and/or to an outer surface of the support cone.

In FIG. 5 the lifting arms 31, 32 of the lifting tool 30 are optionally equipped with limiters 38' which extend around the edge of the opening in the upper end of the inner wear part. I.a. stability of the locking between the lifting tool and the wear part can be increased by the limiters, for example in such a situation when the lifting event is not sufficiently vertical in the initial phase.

In FIG. 6 the lifting arms 31, 32 of the lifting tool 30 are formed hook-like so that the hook-like second counter surfaces 38 couple with the second support surface 15' of the inner wear part 11 having a hook-like cross section. The hook-like shape 15' or a corresponding threshold in the second support surface 15 provides a solution for the lifting of particularly steep inner wear parts. Then the force which is broadening the wear part outwards can be held within reasonable limits. A wedging and sticking of the lifting tool to the wear part can be reduced or eliminated by the hook-like shape or form. A horizontal force component directed to the lifting tool can be eliminated or at least reduced. The hook-like shape or form is formed by a section of the second support surface formed in the second support surface which is in the horizontal direction or over in relation to the lifting direction (the lifting direction is vertical, upwards).

Figure 7:
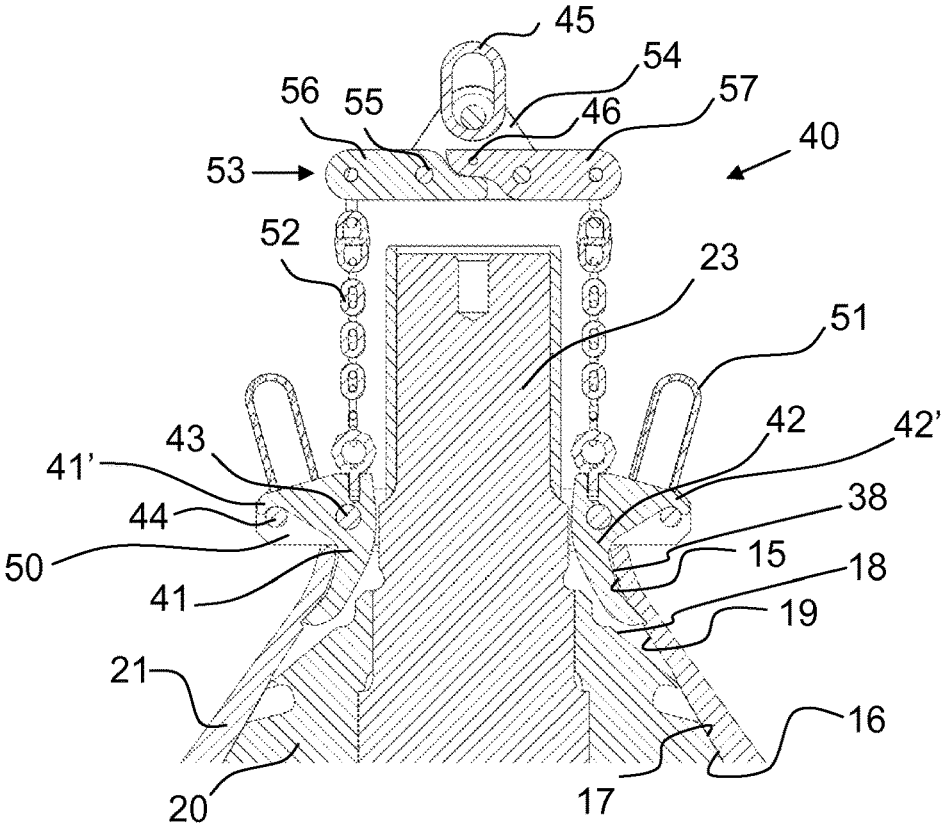
Figure 8:
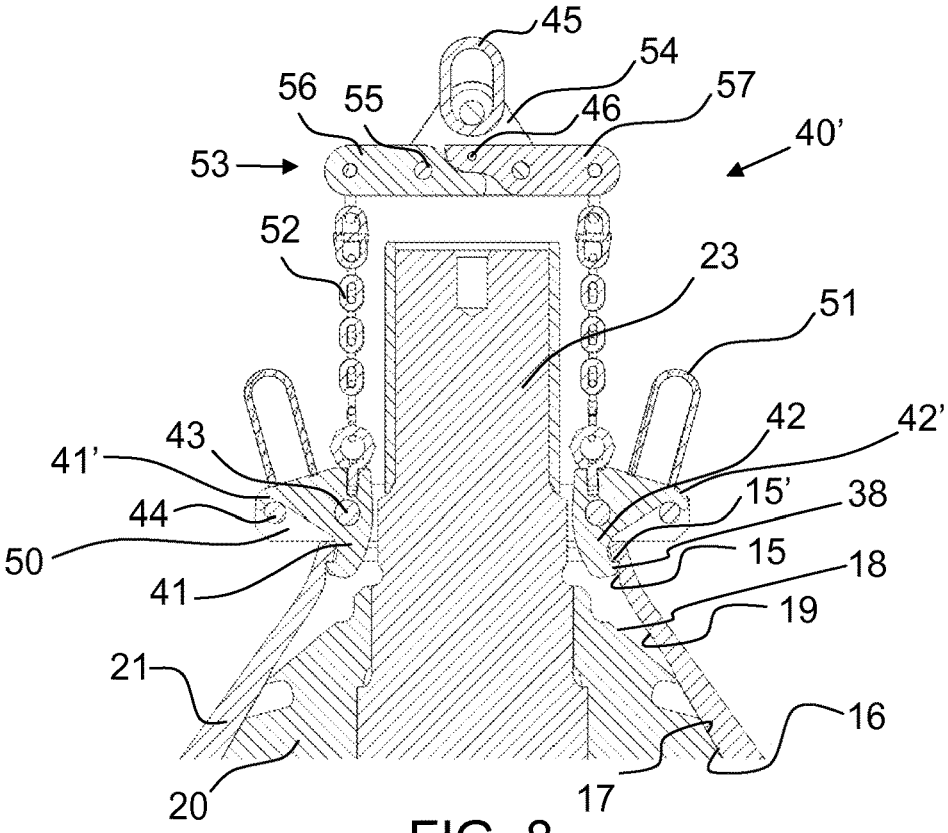
Figure 9:
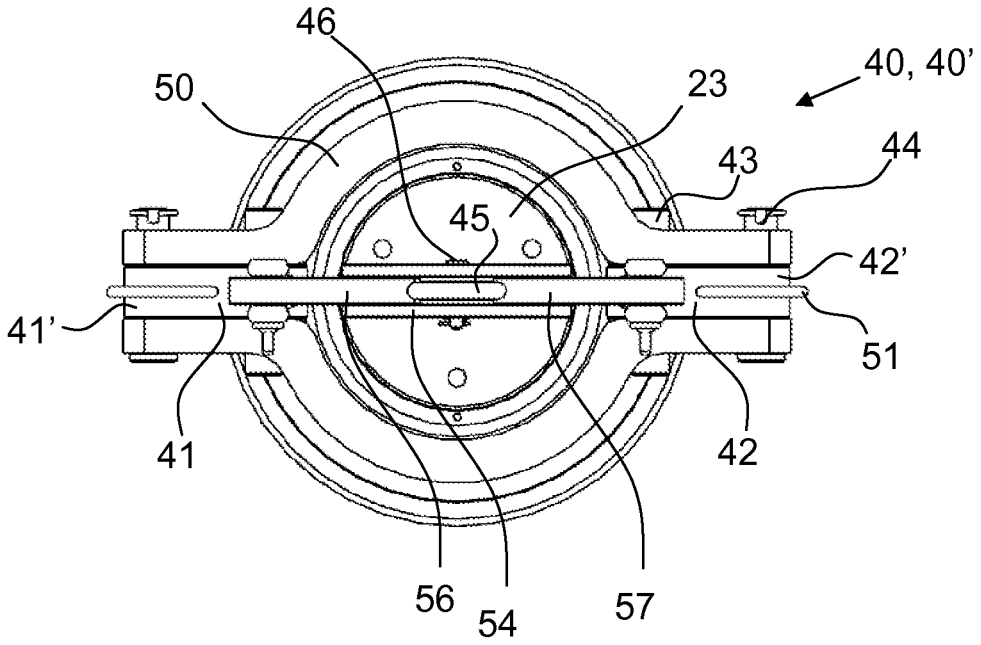
FIG. 9 shows a top view of a lifting tool.

FIGS. 7 and 8 show inner wear parts 21 of a gyratory crusher and lifting tools 40, 40' coupled therewith. FIG. 9 shows a top view of the lifting tool 40, 40'. The lifting tool 40, 40' comprises a first lifting arm 41 and a second lifting arm 42 which are pivoted to a support collar 50 with a pivot 43. The support collar surrounds a shaft 23 in a lifting situation and keeps the lifting arms at a fixed distance from each other. The pivot 43 enables pivoting of the lifting arms in relation to each other (for example with handles 51) and adapting into a lifting tool space between the support cone 20 and the wear part 21 when a locking nut 22 is removed from the shaft 23. If necessary the lifting tool space is emptied from foreign objects. The lifting arms 41, 42 can be locked in a lifting position by placing pins 44 suitable as locking members to obstacles for locking arms 41', 42' of the lifting arms 41, 42 at a point which is located at a desired distance from the pivot 43, for example outside the pivot.

The lifting tool comprises transmission members 52 such as chains for transmitting the lifting force above the shaft 23. The transmission members are fixed at their upper ends to a connection structure 53 to which is fixed a lifting point such as a lifting eye to be gripped by a lifting device. The fixing points of the lower ends of the transmission members 52 in the lifting arms 41, 42 are located so that the lifting force of the transmission members presses the locking arms 41', 42' of the lifting arms against the pins 44. The fixing points of the lower ends of the transmission members 52 in the lifting arms 41, 42 are located so that a "logging tongs" effect can be avoided in the lifting tool 40, 40', i.e. when the load increases there is not directed any increasing pivoting force to the lifting arm which could cause deformations to the lifted wear part.

The lifting tool is optionally equipped with a safety device 46 which indicates overload. The safety device 46 is preferably arranged to the connection structure 53. The connection structure comprises opposite beams 56, 57 pivoted by pivots 55 to a frame 54, where outer ends of the beams have fixing points for the transmission members 52. The safety device 46 comprises a "fuse" such as a shear pin which is coupled in between an inner nose of the beam and the frame. The operator clearly notices the overload at the break of the shear pin when the overlapping inner noses of the beams 56, 57 move shortly against an obstacle formed to the frame, in case of the figure against the lifting eye 45 supported to the frame 54. Naturally the lifting tool can be implemented also with a unitary beam without the safety device.

When the inner wear part 21 is gripped with the lifting tool, regions of at least two lifting arms 41, 42 of the lifting tool 40, 40' having second counter surfaces 38 are arranged inside the inner wear part and under the inner surface of the wear part, and the upper second counter surface 38 of the lifting arm of the lifting tool is coupled with the second inner support surface 15 of the inner wear part 21 which second inner support surface is formed to the upper section of the inner surface of the wear part.

In case the inner wear part 21 is readily on the support cone 20 and one wants to lift the wear part off the support cone, the lifting arm of the lifting tool is arranged into the lifting tool space between the inner wear part and the support cone which lifting tool space is formed by arranging a relief to the inner surface of the inner wear part and/or to an outer surface of the support cone.

In FIG. 8 the lifting arms 41, 42 of the lifting tool 40' are formed hook-like so that the hook-like second counter surfaces 38 couple with the second support surface 15' of the inner wear part 21 having a hook-like cross section. The hook-like shape 15' or a corresponding threshold in the second support surface 15 provides a solution for the lifting of particularly steep inner wear parts which are present particularly in gyratory crushers. Then the force which is broadening the wear part outwards can be held within reasonable limits.

Figure 10:
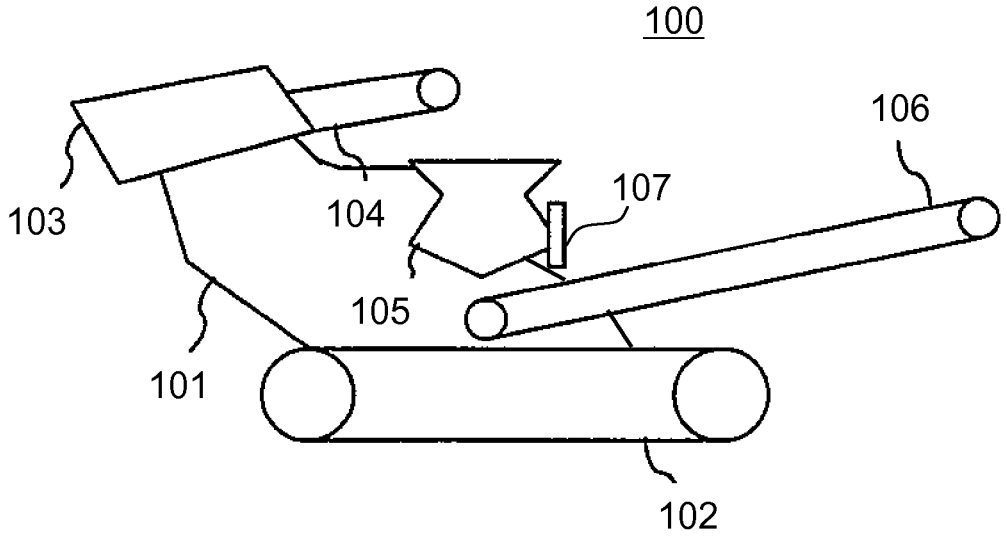
FIG. 10 shows a mineral material processing plant comprising a gyratory or cone crusher equipped with an inner wear part according to the invention.

FIG. 10 shows a mineral material processing plant 100 which is suitable for example to open pits for crushing stone material. A crusher can be operated for example as an intermediate or a secondary crusher. Particularly the crusher can be operated in fine crushing. The processing plant comprises a frame 101 to which is fixed a track base 102 for enabling independent moving. The processing plant comprises a feeder 103 for feeding crushable material to the crusher 105. The feeder preferably also comprises a conveyor 104, and a discharge conveyor 106 for conveying crushed material further to for example a pile beneath the processing plant. Further the processing plant may comprise a power source such as an electric, a diesel or another type motor and a transmission 107 from the power source to the crusher 105.

The feeder may be a lamella feeder or a lamella conveyor, a belt conveyor or a vibrating feeder which may additionally be scalping, separating fine material from the material to be crushed before the crushing.

Instead the track base 102 the moving can be enabled for example also with legs, skids or wheels. The processing plant 100 with the track base can be transported on road on a carriage or a corresponding transport arrangement. With a wheel base it may be towable on road preferably by a truck.

The crusher 105 of the processing plant is preferably any of the cone crusher or gyratory crusher embodiments shown in this description. The crusher 105 can preferably be located to a stationary crushing plant. The processing plant may also be plant operating on water such as a barge, a raft, a ship or for example a plant at the bottom of the sea.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of principles of the invention, and not in limitation thereof. Hence, the scope of the invention is only restricted by the appended patent claims.

The invention claimed is:

1. A method for lifting an inner wear part of a gyratory or cone crusher which gyratory or cone crusher comprises a frame, an outer wear part fixable to the frame and the inner wear part fixable to a support cone of the crusher which outer and inner wear parts together define a crushing chamber for receiving crushable material, and the inner wear part comprises an inner surface comprising a first inner support surface that is arranged, in a crushing phase, to be supported by a first counter surface of the support cone, comprising:

arranging in a first phase two lifting arms of a lifting tool inside the inner wear part and under the inner surface of the inner wear part, wherein the two lifting arms are rigid members and are pivotably joined to each other at a pivot; and coupling in a second phase an upper second counter surface of each of the lifting arms of the lifting tool with a second inner support surface of the inner wear part in corresponding reliefs of the second inner support surface, wherein the second inner support surface is formed in an upper section of the inner surface of the wear part.

2. The method according to claim 1, further comprising arranging, in the first phase in such a situation where the inner wear part is mounted on the support cone, the lifting arm of the lifting tool into a lifting tool space between the inner wear part and the support cone which lifting tool space is formed by the relief.

* * * * *